US005881787A

United States Patent [19]

Davis et al.

[11] Patent Number: 5,881,787

[45] Date of Patent: Mar. 16, 1999

[54] PURSE WITH REPLACEABLE ORNAMENT

[76] Inventors: Joyce G. Davis; Victoria L. Davis, both of 3202 Jefferson Ct., Alpharetta, Ga. 30005

[21] Appl. No.: 914,464

[22] Filed: Aug. 19, 1997

[51] Int. Cl.[6] ..... A45C 1/02; A45C 3/06; A45C 13/08

[52] U.S. Cl. ..... 150/103; 150/118

[58] Field of Search ..... 150/103–105, 150/118; 292/251.5; 24/216

[56] References Cited

U.S. PATENT DOCUMENTS

| | | | |
|---|---|---|---|
| 1,893,931 | 1/1933 | Bromfeld | 150/118 |
| 1,945,268 | 1/1934 | Fielding | 150/104 X |
| 2,006,463 | 7/1935 | Landis | 150/104 |
| 2,029,905 | 2/1936 | Banner | 150/103 |
| 2,080,453 | 5/1937 | Kraut | 150/104 |
| 2,090,937 | 8/1937 | Cohen | 150/106 X |
| 2,656,870 | 10/1953 | Wishnia | 150/104 |
| 2,796,650 | 6/1957 | Van Buren, Jr. | 24/216 |
| 3,087,215 | 4/1963 | Tworek et al. | 24/113 |
| 4,453,294 | 6/1984 | Morita | 24/303 |
| 5,043,116 | 8/1991 | Ossiani | 292/251.5 X |
| 5,572,773 | 11/1996 | Bauer | 292/251.5 X |

FOREIGN PATENT DOCUMENTS

| | | | |
|---|---|---|---|
| 571440 | 3/1959 | Canada | 150/103 |
| 620249 | 4/1927 | France | 150/104 |
| 1319357 | 1/1963 | France | 292/251.5 |
| 2704121 | 10/1994 | France | 150/118 |
| 1519246 | 7/1978 | United Kingdom | 292/251.5 |
| 2137817 | 10/1984 | United Kingdom | 150/118 |
| 2186625 | 8/1987 | United Kingdom | 150/118 |
| 2223793 | 4/1990 | United Kingdom | 150/118 |

*Primary Examiner*—Sue A. Weaver
*Attorney, Agent, or Firm*—Kenneth Watkins, Jr.; Watkins Patent Service

[57] ABSTRACT

A ladies purse comprises an ornamental clasp in which the ornament can be easily changed to allow the purse to be used with different apparel or for different social occasions. The clasp consists of a first magnetic clasp component fixed to the front panel of the purse. A second magnetic clasp component is fixed to the closure flap of the purse. The clasp components engage magnetically to secure the closure flap to the front panel. The second magnetic clasp component comprises an ornament mount for mounting a replaceable ornament on the closure flap of the purse.

17 Claims, 2 Drawing Sheets

PURSE WITH REPLACEABLE ORNAMENT

BACKGROUND OF THE INVENTION

The present invention relates to ladies purses and handbags and, more particularly, to purses having replaceable ornaments.

Ladies purses and handbags serve several important functions including convenient carrying and concealment of makeup, toiletries, keys, valuables and other items. Purses and handbags also serve as fashion accessories which may result in the need to buy, store and maintain a number of purses to complement different wardrobes and for different social occasions. The cost, storage and maintenance requirements to maintain the desired range of purse and handbag fashions may become prohibitive from a cost and storage standpoint.

U.S. Pat. No. 2,656,870 discloses a lady's handbag in which the decorative effects can be changed by a replaceable front panel of the purse. The panel is retained by a thumb nut. Although the appearance of the purse may be changed, the front panel must be made stiff, requiring the purse to be rigid.

U.S. Pat. No. 2,090,937 discloses a handbag with a hinged member which is used to retain gloves on the handbag. The member comprises initials which can be removeably mounted. A conventional clasp is utilized.

U.S. Pat. No. 2,006,463 discloses a locking device for a ladies handbag comprising removable colored plates. A knob must be rotated in register with a block in order to release the clasp.

Theses and other devices for handbags have not solved the need for a handbag which provides a method of quickly and easily changing the appearance and use of a handbag, and also provides a quick and convenient clasp.

OBJECTS AND SUMMARY OF THE INVENTION

Therefore an object of the present invention is to provide a ladies handbag or purse whose appearance may be quickly and easily changed to provide use for different wardrobes and social occasions.

A further object of the present invention is to provide a replaceable ornament for a ladies purse or handbag, the replaceable ornament providing a choice of surface texture, colors, design, and relief.

A further object of the present invention is to provide a replaceable ornament which comprises a clasp component mounted on a highly visible portion of the purse.

A further object of the present invention is to provide a magnetic clasp which is quick and convenient in its use.

A further object of the present invention is to provide a replaceable ornament which comprises a means to prevent rotation of the ornament during normal use.

The invention comprises a ladies purse having a front panel and a closure flap. A clasp is used to secure the closure flap to the front panel and comprises a first magnetic clasp component fixed to the front panel and a second magnetic clasp component fixed to the closure flap. The clasp components comprise magnetic materials which provide a magnetic latching effect when brought together. A radial alignment means such as a pin on one of the clasp components engages an aperture on the other clasp component to prevent radial displacement of one component with respect to the other component when the clasp components are magnetically engaged.

The second magnetic clasp component fixed to the closure flap of the purse comprises an ornament mount. In the preferred embodiment, the mount is a bayonet type mount. A replaceable ornament has a complementary mount component on the back of the ornament which engages the mount to secure the ornament to the second magnetic clasp component in a highly visible portion of the purse. In other embodiments, the mount may be a screw mount, snap mount, or hook and loop fastener mount.

The ornament may comprise a simple disc, covered or finished as desired, or it may comprise different shapes such as rectangular, oval, triangular, heart shaped, or other shapes. Decorative brooches such as sculptured shapes may also be used. In the preferred embodiment, the ornament mount comprises a locking means to prevent rotation of the ornament with respect to the second magnetic clasp component. This feature is important, especially in the use of brooches where the rotational orientation of the ornament is critical.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a purse with replaceable ornament clasp utilizing a convenient magnetic clasp.

Figure 1:
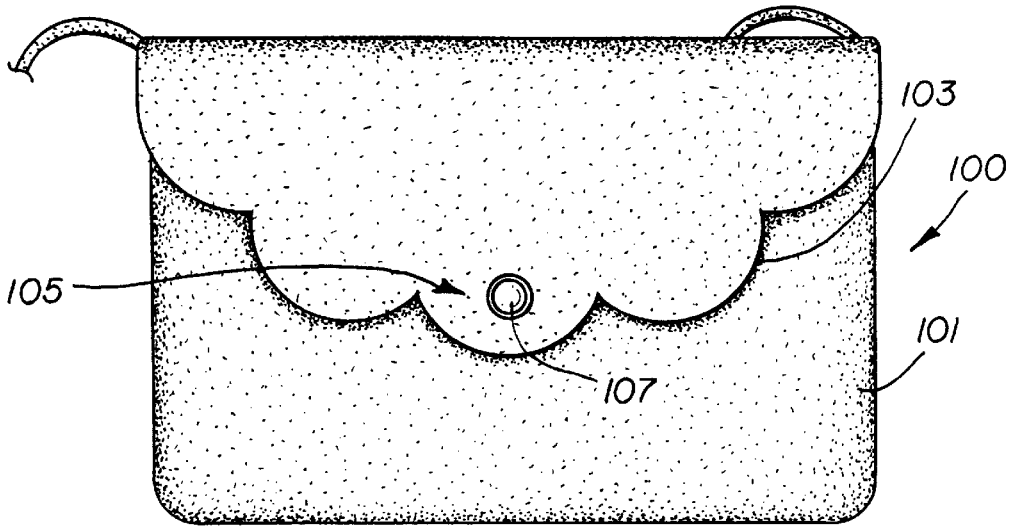
FIG. 1 is a front elevation view of embodiment 100 of a ladies purse having a front panel, closure flap and ornamental clasp.

FIG. 1 is a front elevation view of a purse 100 having a front panel 101, a closure flap 103 and a magnetic clasp 105. Clasp 105 secures closure flap 103 to front panel 101 and comprises a removable ornament 107.

Figure 2:
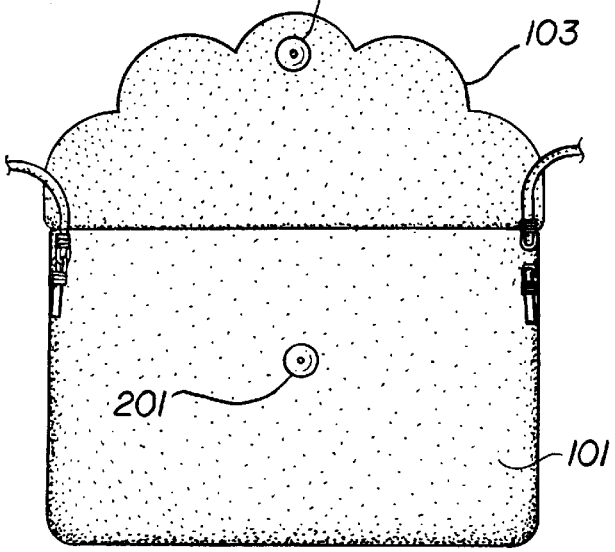
FIG. 2 is a front elevation view of the ladies purse of FIG. 1 showing the closure flap in the open position.

FIG. 2 is a front elevation view of purse 100 showing closure flap 103 in the open position. A first magnetic clasp component 201 of clasp 105 is shown attached to front panel 101. A second magnetic clasp component 203 is attached to closure flap 103.

Figure 3:
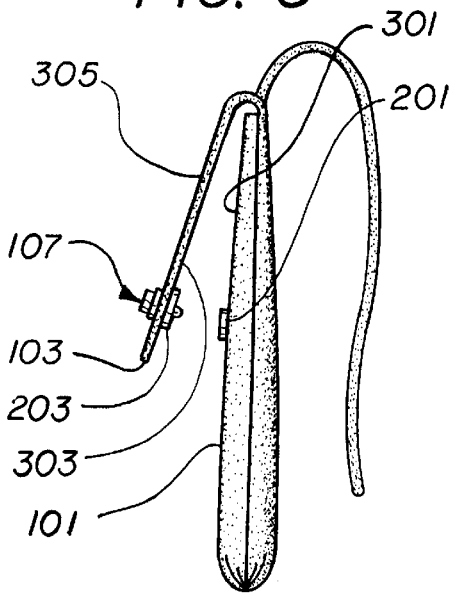
FIG. 3 is a side elevation view of the ladies purse of FIG. 1 showing the first and second magnetic clasp components and the replaceable ornament.

FIG. 3 is a side elevation drawing of purse 100 showing first magnetic clasp component 201 and second magnetic clasp component 203 prior to engagement. First magnetic clasp component 201 is attached to outside surface 301 of front panel 101. Second magnetic clasp component 203 is attached to inside surface 303 of closure flap 103. Removable ornament 107 is mounted on outside surface 305 of closure flap 103.

Figure 4:
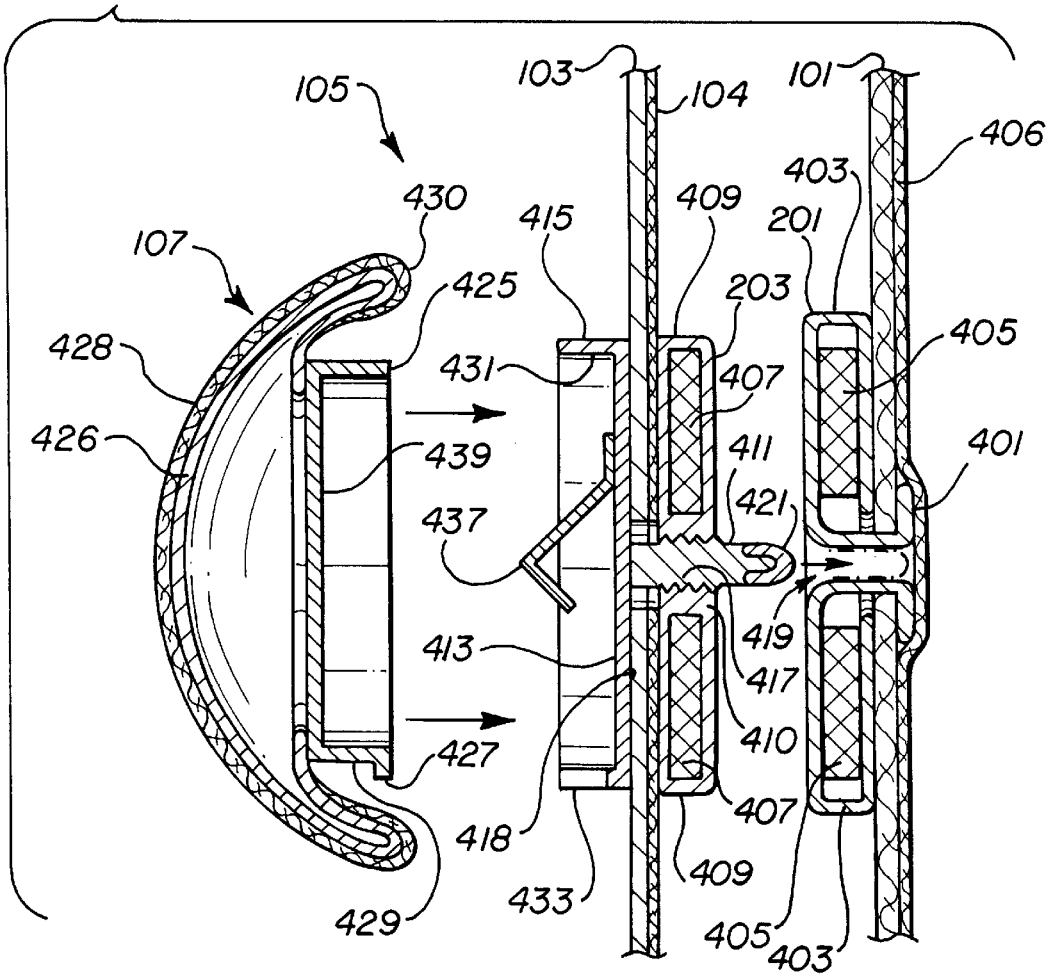
FIG. 4 is a cross sectional view of the first and second magnetic clasp components, ornament mount and a replaceable ornament.

FIG. 4 is a detail cross section of clasp 105. First magnetic clasp component 201 is attached to front panel 101 by a fastener such as crimp flange 401. Can 403 encloses first magnet 405. Magnet 405 may be of any permanent magnetic material and in the preferred embodiment is ring shaped. Other embodiments of magnet 405 are oval, rectangular, or triangular. Can 403 may be metal or plastic, and in the preferred embodiment is a non-magnetic metal such as brass. Crimp flange 401 is attached to can 403. Other fasteners known in the art such as threaded fasteners or press fitted bushings (not shown) may be used. Inner lining 406 encloses crimp flange 401 and provides a neat, finished appearance.

Second magnetic clasp component 203 comprises a second ring shaped magnet 407. Second magnet can 409 encloses second magnet 407. Second can 409 may be metal or plastic, and in the preferred embodiment is a non-magnetic metal such as brass. Threaded bushing 410 may be integral to second can 409, or alternatively, may comprise a separate bushing press fitted to the inside of can 409 (not shown).

Pin 411 is fixed to back plate 413 of ornament receiving element or mount 415, and in the preferred embodiment, comprises a threaded portion 417. Threaded portion 417 of pin 411 engages threaded bushing 410 of second can 409 to fix second magnetic clasp component 203 and mount 415 to purse closure flap 10O. The clamping force resulting from engagement of threaded portion 417 and threaded bushing 410 is normally sufficient to prevent rotation of mount 415 with respect to closure flap 103. Friction elements such as rib 418 on back plate 413 may be used to further reduce the possibility of rotation of mount 415 with respect to closure flap 103. Other fasteners such as snap, crimp or interference fit fasteners may be used to fix second magnetic clasp component 203 to mount 415. Lining 104 presents a neat finished appearance to cover flap 103.

Pin 411 serves a second function as a radial alignment pin when first magnetic clasp component 201 is engaged with second magnetic clasp component 203. Pin 411 is inserted in aperture 419 of first magnetic clasp component 201 when components 201 and 203 are engaged, preventing radial movement of clasp component 201 with respect to clasp component 203. Magnetic attraction between first magnet 405 and second magnet 407 maintains closure of clasp 105 until a separation force is applied sufficient to overcome the magnetic attraction between clasp components 201 and 203. Tip protector 421 is attached to the end of pin 411 to prevent scratching of clasp surfaces. In other embodiments, only one magnet (405 or 407) is a permanent magnet. The complementary element is a magnetic material.

Figure 5:
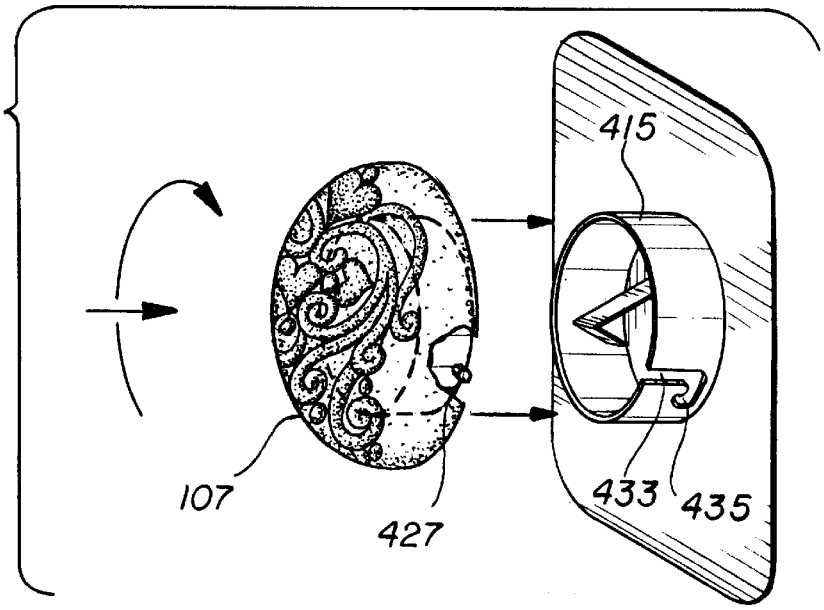
FIG. 5 is a perspective view of the complementary mount component of the replaceable ornament which is inserted and rotated to engage the mount of the second magnetic clasp component.

Replaceable ornament 107 comprises a complementary mount component 425. In the preferred embodiment, mount component 425 is a bayonet type mount component comprising a bayonet pin 427 on flange 429 of mount component 425. Ornament mount flange 429 fits inside of flange 431 of mount 415 when pin 427 is aligned with pin slot 433. Ornament 107 is fully inserted in mount 415 and rotated as shown in FIG. 5 to fully engage pin 427 in hook portion 435 of slot 433. Spring 437 of mount 415 presses against back plate 439 of complementary mount component 425 to bias pin 427 in hook portion 435. Pin 427 and hook portion 435 prevent rotation of ornament 107 with respect to mount 415 during normal use.

Ornament 107 comprises a shaped element 426 fixed to complementary mount component 425. Shaped element 426 may be button shaped as shown in FIG. 4 or it may comprise any ornamental shape or sculpture. Shaped element 426 may comprise a covering 428 such as fabric, plastic, metal plating, or enamel. In the preferred embodiment, shaped element ends 430 extend over flange 429 to cover the mount when mount component 425 is engaged to mount 415.

Other quick fastener means known in the art may be used to attach ornament 107 to mount 415 such as snap type fasteners, screw fasteners, and hook and loop fasteners. In the preferred embodiments, the fastener means prevents rotation of the ornament with respect to mount 415 during normal use. This feature allows use of ornaments in which the orientation is important such as some decorative brooches.

Those skilled in the art will recognize modifications within the spirit of the present invention. For example, the radial alignment function of pin 411 and aperture 419 may be replaced by a flange such as flange 431 on first magnetic clasp component 201 or second magnetic clasp component 203. The flange would have a diameter slightly greater than the diameter of the complementary clasp component so that the clasp components are maintained in radial alignment with each other when the clasp components are magnetically engaged. Other fasteners such as threaded or interference fit fasteners (not shown) may be used to fix first magnetic clasp component 201 to front panel 101.

Accordingly the reader will see that the PURSE WITH REPLACEABLE ORNAMENT provides a purse which can be used for different wardrobes and different occasions by quickly and easily changing clasp ornaments. The device also provides the following features:

The magnetic clasp is quicker and more convenient than snap or lock type clasps;

An alignment pin maintains radial alignment of the clasp components;

Ornaments which require a particular rotational alignment may be used; and

The clasp is simple and inexpensive.

Although the description above contains many specifications, these should not be construed as limiting the scope of the invention hut as merely providing illustrations of some of the presently preferred embodiments of this invention. Thus the scope of the invention should be determined by the appended claims and their legal equivalents, rather than by the examples given.

We claim:

1. A ladies purse with ornamental clasp, the purse comprising:

a first magnetic clasp component fixed to a front panel of the purse;

a second magnetic clasp component fixed to a closure flap of the purse, the second magnetic clasp component magnetically engageable with the first magnetic clasp component;

an ornament mount non-rotateably fixed to the second magnetic clasp component so that the ornament mount is not rotateable with respect to the front panel; and at least one replaceable ornament, the ornament comprising a complementary mount component engageable with the ornament mount.

2. The purse of claim 1 comprising a radial alignment pin fixed to the ornament mount, the radial alignment pin preventing radial misalignment of the first magnetic clasp component with the second magnetic clasp component when the first magnetic clasp component and the second magnetic clasp component are engaged.

3. The purse of claim 2 wherein the radial alignment pin engages the second magnetic clasp to fix the second magnetic clasp component to the closure flap.

4. The purse of claim 1 comprising a means for preventing rotation of the ornament with respect to the ornament mount.

5. The purse of claim 4 wherein the means for preventing rotation of the ornament with respect to the ornament mount is a bayonet mount.

6. The purse of claim 1 comprising a means for providing a unique rotational alignment of the ornament with respect to the closure flap of the purse.

7. The purse of claim 6 wherein the means for providing a unique rotational alignment of the ornament comprises a single locking pin on the complementary mount of the ornament and a single slot in the ornament mount.

8. The purse of claim 7 comprising a spring attached to the ornament mount which biases the locking pin in a locking portion of the slot when the ornament is engaged with the ornament mount.

9. A magnetic clasp with replaceable ornament for a purse, the clasp comprising:

a first magnetic clasp component fixable to a front panel of the purse;

a second magnetic clasp component fixable to a closure flap of the purse, the second magnetic component magnetically engageable with the first magnetic clasp component;

a radial alignment means which prevents radial misalignment of the first magnetic clasp component with respect to the second magnetic clasp component when the first magnetic clasp component and the second magnetic clasp component are engaged;

an ornament mount fixed to the second magnetic clasp component and comprising a friction element to prevent rotation of the ornament mount with respect to the closure flap; and at least one replaceable purse ornament, the ornament comprising a complementary mount component engageable with the ornament mount.

10. The purse clasp of claim 9 wherein the radial alignment means comprises a radial alignment pin fixed to the second magnetic clasp component, the pin engageable with an aperture in the first magnetic clasp component.

11. The purse clasp of claim 10 wherein the radial alignment pin is fixed to the ornament mount and comprises threads engageable with matching threads on the second magnetic clasp component.

12. The purse clasp of claim 9 comprising a means for preventing rotation of the removable ornament with respect to the ornament mount when the ornament is engaged with the ornament mount.

13. The purse clasp of claim 12 wherein the means for preventing rotation of the removable ornament with respect to the ornament mount is a bayonet mount comprising a locking pin on the ornament and a slot on the ornament mount.

14. The purse clasp of claim 13 comprising a spring on the ornament mount which biases the locking pin in a locking portion of the slot when the ornament is engaged with the ornament mount.

15. The purse clasp of claim 9 comprising a means for providing a unique rotational alignment of the ornament with respect to the ornament mount.

16. The purse clasp of claim 15 wherein the means for providing a unique rotational alignment of the ornament comprises a single locking pin on the complementary mount of the ornament and a single slot in the ornament mount.

17. The purse clasp of claim 16 comprising a spring attached to the ornament mount which biases the locking pin in a locking portion of the slot when the ornament is engaged with the ornament mount.

* * * * *